US006213222B1

(12) United States Patent
Banach

(10) Patent No.: US 6,213,222 B1
(45) Date of Patent: Apr. 10, 2001

(54) CAM DRIVE MECHANISM

(75) Inventor: Peter A. Banach, Milwaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 09/480,729

(22) Filed: Jan. 6, 2000

(51) Int. Cl.[7] ..... B25D 11/10

(52) U.S. Cl. ..... 173/1; 173/104; 173/109; 173/205

(58) Field of Search ..... 173/104, 109, 173/205, 122, 124, 178, 1

(56) References Cited

U.S. PATENT DOCUMENTS

| | | | |
|---|---|---|---|
| Re. 35,372 | 11/1996 | Houben et al. . | |
| 2,153,883 | 4/1939 | Foster . | |
| 2,703,029 | 3/1955 | Steukers . | |
| 3,015,244 | 1/1962 | Newman . | |
| 3,270,821 | 9/1966 | Bassett et al. . | |
| 3,841,418 | 10/1974 | Biersack . | |
| 4,098,351 | 7/1978 | Alessio . | |
| 4,384,622 | 5/1983 | Koziniak . | |
| 4,567,950 | 2/1986 | Fushiya et al. . | |
| 5,025,869 | 6/1991 | Terunuma et al. . | |
| 5,125,461 | 6/1992 | Hoser . | |
| 5,159,986 | 11/1992 | Hoser . | |
| 5,494,115 | 2/1996 | Hwong . | |
| 5,505,271 | 4/1996 | Bourner . | |
| 5,653,294 | 8/1997 | Thurler . | |
| 5,711,379 | 1/1998 | Amano et al. . | |
| 5,711,380 | 1/1998 | Chen . | |
| 5,908,076 * | 6/1999 | Marcengill et al. | 173/205 |
| 6,085,849 * | 7/2000 | Scigliuto | 173/178 |

FOREIGN PATENT DOCUMENTS

| | | |
|---|---|---|
| 1373486 A1 | 2/1988 | (SU) . |

* cited by examiner

*Primary Examiner*—Scott A. Smith
(74) *Attorney, Agent, or Firm*—Michael Best & Friedrich LLP

(57) ABSTRACT

A cam drive hammer mechanism. The drive mechanism includes a drive mechanism housing connectable to the housing of the power tool, a first cam member, a second cam member and a gear assembly for drivingly connecting the first cam member and the second cam member to the drive shaft for counter-rotation. The first cam member and the second cam member each have at least one of cam surface, the cam surfaces being oriented at a steep angle with respect to the axis of the tool element, each of the cam surfaces being complementary and engageable with one another. The second cam member includes an impacting surface for engaging the tool element to provide an impact. As the cam members counter-rotate, the cam surfaces engage so that the second cam member is axially moved in a direction relative to the first cam member. As the cam members continue to counter-rotate, the cam surfaces disengage so that the second cam member is axially moved in an opposite direction relative to the first cam member to provide an impact on the tool element. Preferably, each cam member includes less than five, and, most preferably, two cam surfaces, and the cam surfaces are oriented at between approximately 30° and 60° with respect to the axis of the tool element.

22 Claims, 9 Drawing Sheets

CAM DRIVE MECHANISM

BACKGROUND OF THE INVENTION

The present invention relates to power tools and, more particularly, to an impacting drive mechanism for a power tool.

A hammer drill is one type of power tool including an impacting drive mechanism or hammer mechanism. Typically, the hammer mechanism includes first and second cam members having mating ratchet surfaces and a spring to bias the cam members and ratchet surfaces out of engagement. An externally applied biasing force is necessary to overcome the spring bias to cause the ratchet surfaces into engagement. Normally, the first cam member is connected to a rotating spindle and is rotated relative to a second cam member rotatably-fixed to the hammer drill housing to provide a ratcheting action. The relative rotation causes the cam member surfaces to slide and cause the second cam member to separate and move axially relative to the first cam member as the external force is overcome. After the apexes of the ratchet surfaces pass one another, the continually applied external biasing force causes the ratchet surfaces to re-engage, providing an impact.

A rotary hammer is another type of power tool including a hammer mechanism. This hammer mechanism typically includes a free floating impacting mass pneumatically driven by a reciprocating piston.

SUMMARY OF THE INVENTION

One problem with the above-described hammer drill is that, typically, the ratchet surfaces have a low angle of rise and, because a high external biasing force is required for effective impacting, a high rotational frictional force is developed, making the hammering operation inefficient.

Another problem with the above-described hammer drill is that the cam members generally have a large number of ratchet surfaces (10–20). This reduces the impact energy per blow (due to a large number of impacts for a given amount of input energy).

Yet another problem with the above-described hammer drill is that, because the impact-receiving ratchet surfaces are radially spaced from the axis of the spindle and the tool element, the impact energy is transmitted at a radial distance from the axis of the spindle and from the axis of the tool element, resulting in inefficient energy transmission to the tool element. Also, because the impact-receiving ratchet surfaces are angled relative to the axis, a transverse impact force causes an unnecessary moment on the cam members and a further reduction in energy transmission to the tool element.

A further problem with the above-described hammer drill is that, to operate effectively and generate impacts, the hammer mechanism requires a substantial axial force be applied by the operator to accelerate the mechanism forward so that contact is maintained between the ratchet surfaces. The operator becomes a part of the hammer mechanism and, as a result, influences the magnitude of the impact energies developed and the frequency of the impacts. For example, if the operator applies an insufficient axial force, some of the ratchet surfaces can be skipped over as the cam members separate and rotate, decreasing the number of impacts per rotation. Also, the operators application of axial force determines the magnitude of the impact energy that can be converted from a given magnitude of input energy. Further, since the axial force applied by the operator is part of the mechanical system, a constant application of a significant axial force and effort is required.

Another problem with the above-described hammer drill is that, to allow for rotation of the spindle without hammering action, the hammer mechanism includes a mechanism, generally requiring numerous additional components, to prevent the spindle from moving axially and/or to prevent the ratchets from contacting while the spindle rotates. These additional components increase the cost and complexity of the hammer mechanism.

Yet another problem with the above-described hammer drill is that, typically, the rotational speed and torque of the spindle for hammering and drilling in masonry materials is inappropriate for large accessories used for other materials. As a result, a secondary gear set, for speed and torque selection by the operator, is necessary as an option in the hammer drill. Misuse of this option can reduce the performance of the accessory and reduce the life of the hammer mechanism.

A further problem with the above-described hammer drill is that, because one of the cam members is rotatably fixed, the number of impacts per spindle rotation and the resulting impact pattern on the workpiece, with a given tool element, is determined solely by the number of ratchet teeth. The combination of impact pattern, frequency and energy cannot be optimized for cutting of the material of the workpiece.

One problem with the above-described rotary hammer is that the rotary hammer is more expensive to manufacture and maintain. The hammering mechanism of the rotary hammer has more critical components and is more complex and therefore is more susceptible to mechanical failure. The hammering mechanism of the rotary hammer requires the high precision and prevention of contamination typical of these systems.

Another problem with the above-described rotary hammer is that part of the hammer mechanism, such as a slider crank, wobble plate or other secondary hammer drive mechanism, contributes to the overall mechanism being relatively large and cumbersome.

Yet another problem with the above-described rotary hammer is the impact force is dependent on the speed of the motor. Specifically, when the motor speed is reduced, the speed of the piston and the force applied to the impacting mass are reduced. As a result, at lower motor speeds, the impact force of the hammering mechanism is reduced. Such low speed operations may occur when the operator reduces the motor speed to conduct detailed hammering or to operate on a fragile workpiece. Lower speed operations may also result when operating in a cordless mode on battery power (as compared to operations in a corded mode).

The present invention provides a drive mechanism for a power tool that alleviates the problems with the above-described hammer drill and rotary hammer. The present invention provides a drive mechanism including a drive mechanism housing connectable to the housing of the power tool, a first cam member, a second cam member and a gear assembly for drivingly connecting the first cam member and the second cam member to the drive shaft for counter-rotation. The first cam member and the second cam member each have a plurality of cam surfaces, the cam surfaces being oriented at a steep angle with respect to the axis of the tool element, each of the cam surfaces being complementary and engageable. The second cam member includes an impacting surface for engaging the tool element to provide an impact.

As the cam members counter-rotate, the cam surfaces engage so that the second cam member is axially moved in a direction relative to the first cam member. As the cam members continue to counter-rotate, the cam surfaces disengage so that the second cam member is axially moved in an opposite direction relative to the first cam member to provide an impact on the tool element.

Preferably, each cam member includes at least one cam surface, and, with the minimum or maximum number of cam surfaces being determined by the response of the spring and mass system for a given input that results in impact energy transfer to the tool element before the cam surfaces re-engage. The cam surfaces are preferably oriented at between 30° and 60° with respect to the axis of the tool element.

Also, the cam members are counter-rotated relative to one another at a rate of counter-rotation. The gear assembly may include a first gear drivingly connected to the first cam member and a second gear drivingly connected to the second cam member. In addition, the rate of counter-rotation of the cam members is selectable to change the impact pattern of the cutting tooth of the tool element in the workpiece.

Preferably, the drive mechanism is formed as a modular assembly and is connected to the housing of the power tool and to the motor.

The drive mechanism preferably further comprises a spring for biasing the cam members into engagement, and a spring housing supporting the spring and the second cam member, the spring being between the spring housing and the second cam member. The spring housing is preferably rotatably supported by said housing and connected between the gear assembly and the second cam member. The drive mechanism may further comprise a striker member supported force transmitting relation to the tool element and having an impact-receiving surface engageable by the impacting surface of the second cam member. Preferably, before the cam surfaces re-engage, the impacting surface impacts the impact receiving surface to provide an impact to the tool element.

The drive mechanism may further comprise a preventing mechanism to prevent the drive mechanism from imparting axial motion on the tool element, said preventing mechanism being operable to one of selectively disconnect one of the cam members from the drive shaft.

Also, the present invention provides a power tool including a housing, a motor supported by the housing and connectable to a power source, the motor including a rotatably driven drive shaft, a support member supported by the housing, the support member being adapted to support a tool element so that the tool element is movable relative to the housing, the tool element having an axis and being driven by the power tool to work on a workpiece, and a drive mechanism connectable to the drive shaft and operable to impart an axial motion on the tool element.

In addition, the present invention provides a method of optimizing a power tool. The method includes selecting a first gear ratio between the first cam member and the drive shaft, selecting a second gear ratio between the second cam member and the drive shaft, and changing one of the first gear ratio and the second gear ratio to optimize the impact pattern of the cutting tooth of the tool element on the workpiece.

One advantage of the present invention is that, because of the steeper angle of rise of the cam surfaces on the cam members, the hammer mechanism provides a higher mechanical efficiency due to more efficient cam angles.

Another advantage of the present invention is that due to the fewer number of cam surfaces, compared to the number of ratchet surfaces in a typical hammer drill, a given amount of rotational energy can be converted to a higher energy per impact (due to fewer impacts for a given period of time).

Yet another advantage of the present invention is that, because the impacting projection of the impacting cam extends along the axis of the spindle and along the axis of the tool member, the longitudinal impacts are provided along the axis of the hammer mechanism and the tool element, decreasing the impact energy lost from off axis and transverse forces.

A further advantage of the present invention is that a lower axial force is required to generate higher impact energies because the energy developed is stored in a spring. This results in less operator exertion. In addition, the operator's link to the hammer mechanism is softened by the spring and through various cushioning interfaces throughout the hammer mechanism. Also, the axial force that must be supplied by the operator to achieve optimum performance is minimized.

Another advantage of the present invention is that the hammer mechanism is more compact than other conventional hammer mechanisms, such as those employing a slider crank or a wobble plate or requiring a secondary system to drive the hammer mechanism. The drive system of the hammer mechanism of the present invention, in power tools including a rotary drive system, is coupled to the spindle through the rotary drive system. Also, the hammer mechanism can be employed with power tools providing only axial hammering impacting motion or providing both axial hammering motion with spindle rotation or providing only spindle rotation. In addition, the hammer mechanism is provided in a modular assembly which is connectable with a motor housing and motor of a power tool to replace another hammering mechanism.

Yet another advantage of the present invention is that the means for selecting the operating mode, such as hammering with spindle rotation or spindle rotation only, is easily accomplished, and the hammering mechanism does not require numerous additional components for mode selection. As a result, the power tool and the hammering mechanism of the present invention are simpler and less expensive to manufacture and maintain.

A further advantage of the present invention is that if rotation of the spindle is necessary without hammering motion, the speed and torque of the spindle is appropriate for applications requiring larger accessories in materials other than concrete or masonry.

Another advantage of the present invention is that, if hammering and spindle rotation is necessary, the parallel drive path allows for optimization of an indexing ratio, controlling the degree of angular rotation of the spindle between impacts. Because the indexing ratio can be optimized, the impact pattern of the tool element on the workpiece can be controlled and optimized for the tool element and the material of the workpiece.

Yet another advantage of the present invention is that, because the spindle is axially fixed, the spindle can accommodate a chucking device for grasping smooth shank tool elements, other accessory capturing devices, and other accessories that are common in the industry without the requirement of a special adapter.

A further advantage of the present invention is that the hammer mechanism is less complex and more durable than the hammer mechanism of the rotary hammer.

Another advantage of the present invention is that the impact force of the present hammer mechanism is substantially independent of the speed of the motor. The impact force is related to the biasing force of the spring and the mass of the impacting cam. As a result, at any speed, the impact force of the present hammer mechanism is substantially constant.

Other features and advantages of the invention will become apparent to those skilled in the art upon review of the following detailed description, claims and drawings.

Figure 1:
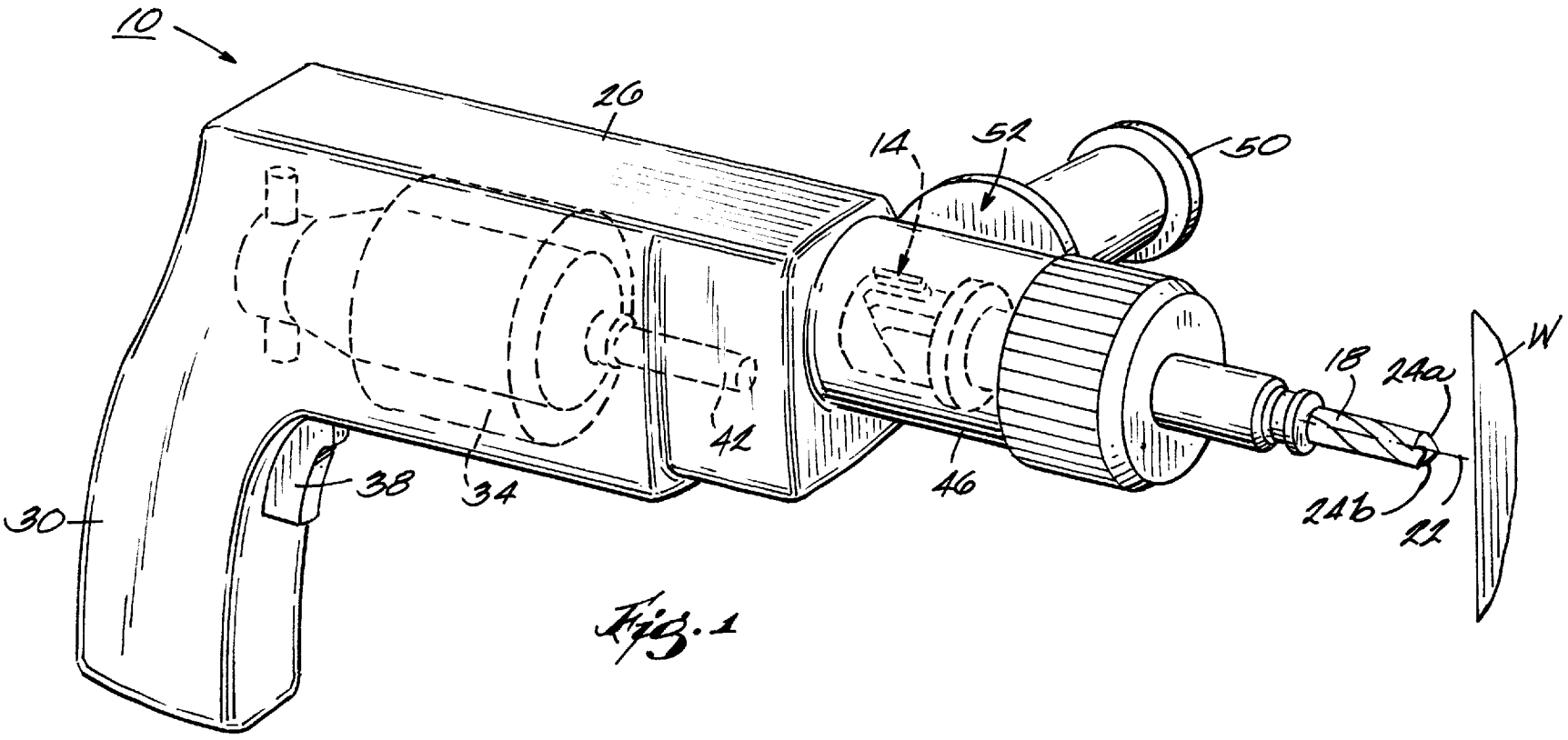
FIG. 1 is a perspective view of a power tool including a hammer mechanism embodying the invention.

Before one embodiment of the invention is explained in detail, it is to be understood that the invention is not limited in its application to the details of the construction and the arrangements of the components set forth in the following description or illustrated in the drawings. The invention is capable of other embodiments and of being practiced or carried out in various ways. Also, it is understood that the phraseology and terminology used herein is for the purpose of description and should not be regarded as limiting.

DETAILED DESCRIPTION OF THE PREFERRED EMBODIMENT

A power tool 10 including a cam drive hammer mechanism 14 embodying the invention is illustrated in FIG. 1. As explained in more detail below, the hammer mechanism 14 is operable to drive a tool element 18 for reciprocating, impacting or hammering movement along an axis 22. It should be understood that the power tool 10 can be any type of power tool in which the tool element 18 is driven for axial movement. Such power tools include chippers, nailers, hammer drills, rotary hammers, chipping hammers and, in general, impacting devices. It should be understood that the power tool 10 can also include a mechanism to drive the tool element 18 for rotary motion about the axis 22. In the illustrated construction, the power tool 10 is operable to, in one mode, drive the tool element 18 for both a rotary or drilling motion and a reciprocating or hammering motion. In the illustrated construction, the tool element 18 includes at least one carbide or cutting tooth 24, and preferably, at least two cutting teeth 24*a* and 24*b*.

The power tool 10 includes a motor housing 26 having a handle portion 30. A reversible electric motor 34 (schematically illustrated) is supported by the motor housing 26. An on/off switch 38 is supported on the handle 30 and is operable to connect the motor 34 to a power source (not shown). The motor 34 is operable to rotatably drive a drive shaft 42 (partially shown in FIG. 1).

The power tool 10 also includes (see FIG. 1) a forward housing 46 supporting the hammer mechanism 14. An auxiliary side handle 50 is supported on the forward housing 46. In the illustrated construction, the auxiliary handle 50 is of a band clamp type and is releasably secured about the forward housing 46.

In the illustrated construction, the forward housing 46 surrounds the hammer mechanism 14 to provide a modular hammer mechanism assembly 52. The modular hammer mechanism assembly 52 is connected to the motor housing 26 and the motor 34 to form the power tool 10. It should be understood that, in other constructions (not shown), the power tool 10 may be formed as a single unit including a non-modular hammer mechanism (similar to hammer mechanism 14) and a forward housing (similar to forward housing 52).

The hammer mechanism 14 includes (see FIG. 2A) a gear assembly 54. A pinion shaft 58 is drivingly connected to the drive shaft 42. The pinion shaft 58 drives an intermediate gear 66 fixed to an intermediate shaft (not shown). An intermediate pinion 70 is also fixed to the intermediate shaft and is driven with the intermediate gear 66 at the same rotational speed and in the same direction.

The gear assembly 54 also includes a spindle gear 74 fixed to a rotatable spindle 78. Spindle gear 74 is driven by intermediate pinion 70. The spindle 78 is supported by bearings 60 and 61 so that the spindle 78 is rotatable but axially immovable. The spindle 78 is generally hollow and, within its forward portion, defines a plurality of axially-extending splines 80, the purpose for which is explained in more detail below.

The gear assembly 54 also includes an idler gear 82 fixed to an idler shaft 86. Idler gear 82 is also driven by intermediate pinion 70. An idler pinion 90 is also fixed to the idler shaft 86 so that the idler gear 82, the idler shaft 86 and the idler pinion 90 rotate in the same direction and at the same speed.

The gear assembly 54 also includes a housing gear 94 fixed to a rotatable spring housing 98. The housing gear 94 is driven by the idler pinion 90. In this manner, the spring housing 98 and the spindle 78 rotate in opposite directions, i.e., counter-rotate. The spring housing 98 defines a plurality of axial slots 100, the purpose for which is explained in more detail below.

The hammer mechanism 14 also includes (see FIGS. 2A and 3) a drive cam 102 supported by the spindle 78. In the illustrated construction, the drive cam 102 is axially fixed within the spindle 78 and, as explained in more detail below, is rotatable, in some instances, with the spindle 78. In the illustrated construction, a central opening 104 is defined by the drive cam 102. The purpose for the opening 104 is explained in more detail below.

The drive cam 102 includes at least one and, preferably, a plurality of cam driving surfaces 106. In the illustrated construction, the drive cam 102 has two cam driving surfaces 106. The cam driving surfaces 106 are helical in shape and have a relatively steep angle, i.e., greater than 30° and less than 65°, with respect to the axis 22. Preferably, the cam driving surfaces 106 are angled at least 35° with respect to the axis 22. The drive cam 102 also includes a plurality of ratchet members 110 facing opposite the cam driving surfaces 106. The purpose for the ratchet members 110 is explained in more detail below.

The hammer mechanism 14 also includes an impacting cam 114. The impacting cam 114 is supported by the spring housing 98 so that the impacting cam 114 is rotatable with the spring housing 98. The impacting cam 114 is also axially movable relative to the spring housing 98. The impacting cam 114 includes a plurality of lateral projections 118 which extend into respective axial slots 100 formed in the spring housing 98. The lateral projections 118 and the axial slots 100 cooperate so that the impacting cam 114 is rotatably fixed to the spring housing 98.

The impacting cam 114 also includes cam surfaces 122 which are complementary to, mate with and conform to the cam driving surfaces 106 on the drive cam 102. The cam surfaces 122 are also helical in shape and also have a relatively steep angle, i.e., greater than 30° and less than 65°, with respect to the axis 22. Preferably, the cam surfaces 122 are angled at least 35° with respect to the axis 22, the same angle as the cam driving surfaces 106. The cam surfaces 106 and 122 are configured to slide against one another when the drive cam 102 is rotated in the direction of arrow A (in FIG. 2A) while the impacting cam 114 is counter-rotated in the direction opposite to arrow A.

It should be understood that, in the illustrated construction, both the drive cam 102 and the impacting cam 114 are rotated and, preferably, are counter-rotated relative to one another. However, in some constructions (not shown), only one of the drive cam 102 and the impacting cam 114 may be rotated. Also, in some other constructions (not shown), the drive cam 102 and the impacting cam 114 may be rotated in the same direction but at different rates of rotation.

The impacting cam 114 also includes (see FIGS. 2B, 2D and 3) a forwardly extending impacting projection 126 having an impacting surface 130. The impacting cam 114 is supported so that the impacting projection extends into the opening 104 in the drive cam 102. Preferably, the impacting surface 130 is substantially perpendicular to and centered on the axis 22.

The hammer mechanism 14 also includes (see FIG. 2A) a spring 134 positioned between the spring housing 98 and the impacting cam 114. The spring 134 biases the impacting cam 114 forwardly into engagement with the drive cam 102. The spring 134 is axially restrained and has a small amount of preloading.

The hammer mechanism 14 also includes (see FIGS. 2A and 3) a striker 138. The striker 138 is rotatably coupled to the spindle 78. In the illustrated construction, the striker 138 includes a plurality of axially-extending splines 142 which are engageable with the splines 80 formed on the spindle 78 so that the striker 138 rotates with the spindle 78 but is axially movable relative to the spindle 78.

A plurality of ratchet members 146 are formed on the rear surface of the striker 138. The ratchet members 146 are engageable with ratchet members 110 of the drive cam 102. In the construction shown in FIG. 3, the ratchet members 146 and 110 are configured so that, when the striker 138 is driven in the direction of arrow A (in FIG. 2A), the ratchet members 146 and 110 are drivingly engaged and the drive cam 102 rotates with the striker 138 and with the spindle 78. When the striker 138 is rotated in the direction opposite to arrow A (in FIG. 2A), the ratchet members 146 and 110 do not drivingly engage but slide over one another so that the drive cam 102 does not rotate with the striker 138 and the spindle 78. In the illustrated construction, the striker 138 defines a circumferential groove 148, the purpose of which is explained in more detail below.

The striker 138 has (see FIGS. 2B, 2D and 3) a rearwardly-extending impacting projection 150 having an impact-receiving surface 152. The impact-receiving surface 152 is complementary to and engageable with the impacting surface 130 on the impacting projection 126. Preferably, the impact-receiving surface 152 is also substantially perpendicular to and centered on the axis 22. In the illustrated construction, the impact projection 150 extends into the opening 104 formed in the drive cam 102.

The impacting projections 126 and 150 have a sufficient length so that, during an impact, the impacting projections 126 and 150 impact before the cam surfaces 106 and 122 re-engage. This ensures that no energy loss occurs due to transverse forces. Also, because the impacting projections 126 and 150 are centered on the axis 22, impact energy is transmitted efficiently. Also, impacting cam 114 and spring 114 have a spring and mass relationship to cause impacting cam 114 to achieve the acceleration and impact velocity necessary to ensure that impact occurs before cam surfaces 106 and 122 re-engage as drive cam 102 and impacting cam 114 counter-rotate.

The hammer mechanism 14 also includes (see FIGS. 2A and 4) a mechanism 154 for disengaging the hammering mode. The mechanism 154 includes a plurality of balls 158 engageable with the groove 148 formed in the striker 138. The balls 158 are supported in radial openings 162 formed in the spindle 78. The mechanism 154 also includes a rotatable locking collar 166 having a locking cam surface 170 formed on its inner surface and defining positions 170*a* and 170*b*. An axially-movable cam rider 174 is positionable in the positions 170*a* and 170*b*. Portions of the cam rider 174 extends through openings 176 formed in the forward housing 46 to engage an axially-movable locking ring 178. A spring 180 biases the mechanism 154 to a position in which the cam rider 174 is in position 170*a*.

Figure 2A:
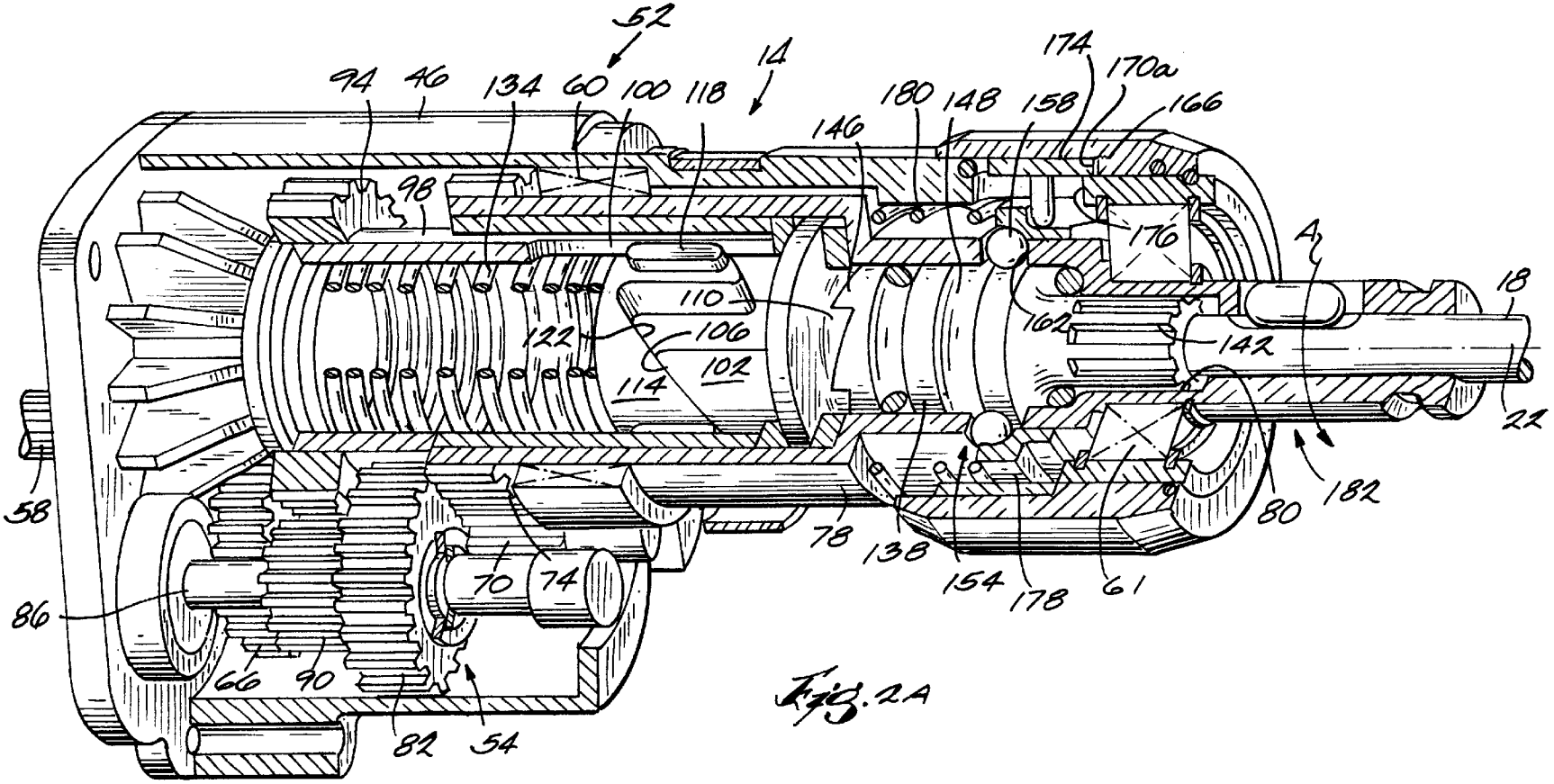
FIGS. 2A–D are perspective views of the hammer mechanism shown in FIG. 1 and illustrating the operation of the hammer mechanism.
Figure 2B:
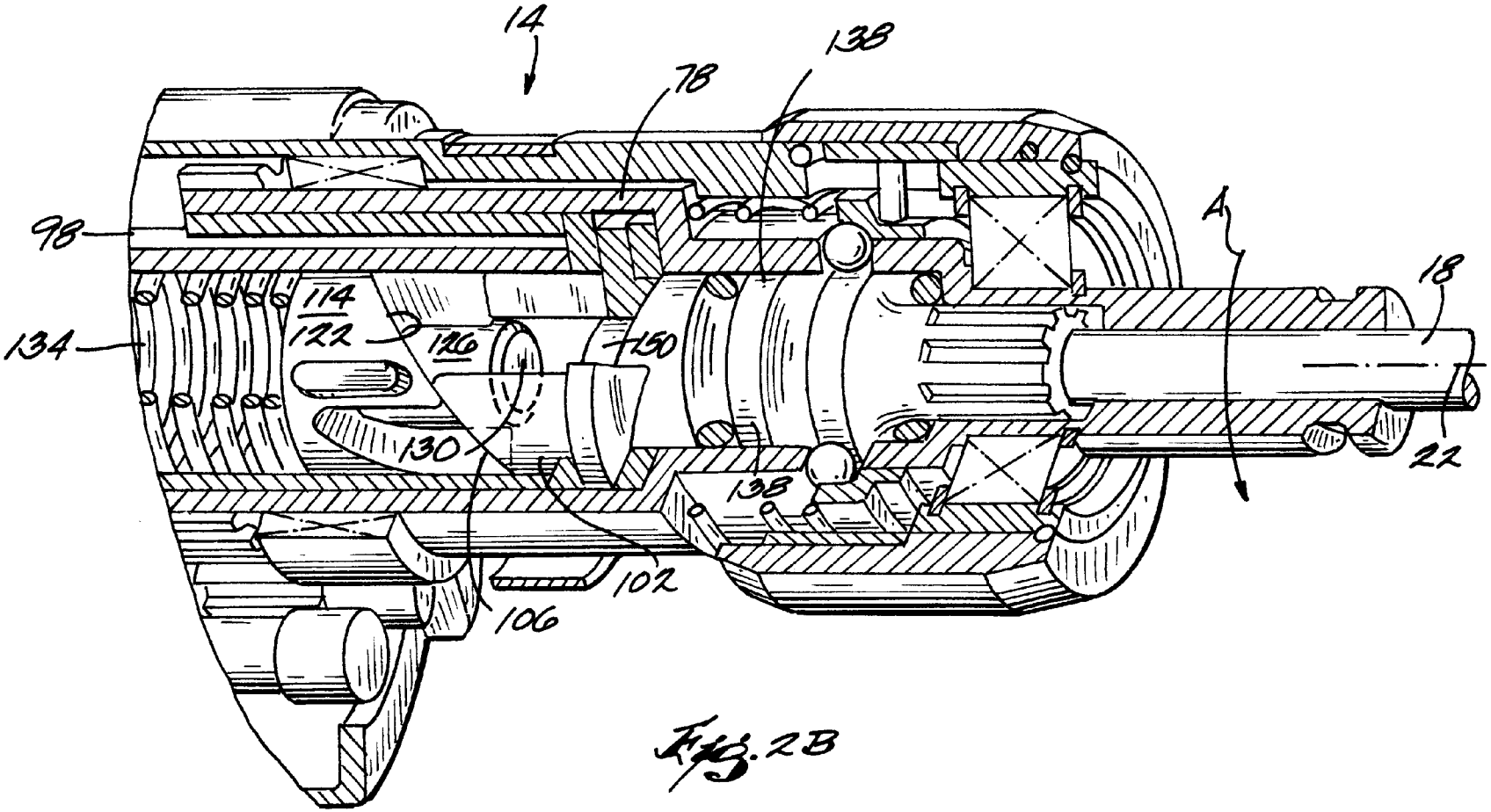
Figure 3:
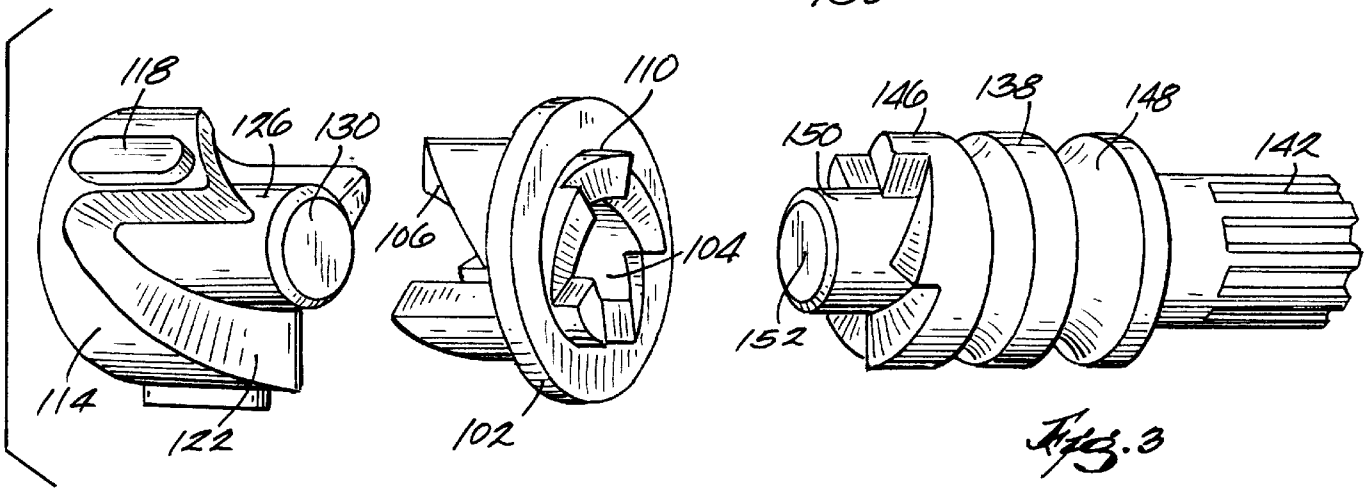
FIG. 3 is an exploded perspective view of a portion of the hammer mechanism shown in FIG. 2A.

In the position shown in FIG. 2A, the hammer mechanism 14 is in the hammer mode. The cam rider 174 is in position 170*a*, and the locking ring 178 is positioned to allow the balls 158 to extend through the openings 162. The balls 158 do not engage the groove 148 formed in the striker 138, and the striker 138 is free to engage the drive cam 102 so hammering is provided. The geometry of groove 148 facilitates balls 158 to move out of groove 148 and into openings 162.

Figure 4:
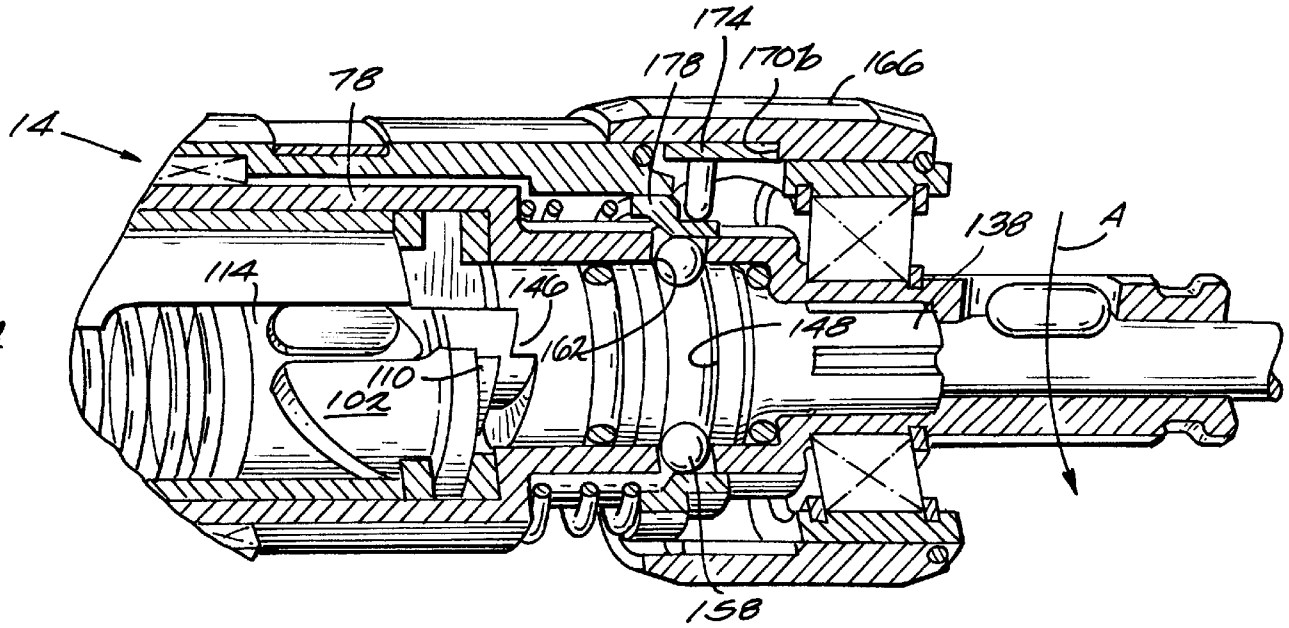
FIG. 4 is a perspective view of the hammer mechanism shown in FIG. 2A and illustrating the hammer mechanism in a mode without hammering action.

To disengage the hammer mode, the tool element 18 is lifted from the workpiece W. As shown in FIG. 4, the spring 134 forces the impacting cam 114 and the striker 138 forwardly so that the groove 148 is aligned with the balls 158 and the openings 162. The locking collar 166 is rotated so that the cam rider 174 moves to position 170*b*. In this position, the locking ring 178 covers the openings 162 and forces and restrains the balls 158 into the groove 148. The striker 138 cannot engage the drive cam 102, and the drive cam 102 does not counter-rotate relative to the impacting cam 114. Hammering action is thus prevented.

To re-engage the hammer mode (see FIG. 2A), the locking collar 166 is rotated so that the balls 158 can move out of the groove 148.

The power tool 10 also includes (see FIG. 2A) a support member or chucking device 182 for supporting the tool element 18. The chucking device 182 is supported by the spindle 78 for rotation with the spindle 78. The chucking device 182 may be any type of chucking device capable of securely holding the tool element 18 during operations including drilling only, hammering only, or both drilling and hammering. In the illustrated construction, the chucking device 182 permits limited axial movement of the tool element 18 relative to the chucking device 182.

In operation, the motor 34 rotatably drives the drive shaft 42 in a forward mode. The drive shaft 42 drives the gear assembly 54 so that the spindle 78 rotates in the direction of arrow A and so that the spring housing 98 and the impacting cam 114 counter-rotate. The striker 138, the chucking device 182 and the tool element 18 rotate with the spindle 78. In the mode shown in FIG. 4, the drive cam 102 is disengaged from the striker 138 and does not rotate with the spindle 78. Instead, the drive cam 102 rotates with the impacting cam 114.

The operator selects the hammering mode by rotating the locking collar 166 to allow the balls 158 to move out of the groove 148. The striker 138 is now free to move axially. When the operator engages the tool element 18 against the workpiece W, the tool element 18 is pushed rearwardly against the striker 138 (as shown in FIG. 2A). The striker 138 is forced rearwardly so that the ratchet members 110 and 146 engage. As a result, the drive cam 102 now rotates with the striker 138 and the spindle 78. Continued counter-rotation of the spring housing 98 and the impacting cam 114 causes the cam surfaces 106 and 122 to slide against one another. The impacting cam 114 is forced rearwardly (from the position shown in FIG. 2A to the position shown in FIG. 2C) against the biasing force of the spring 134.

Figure 2C:
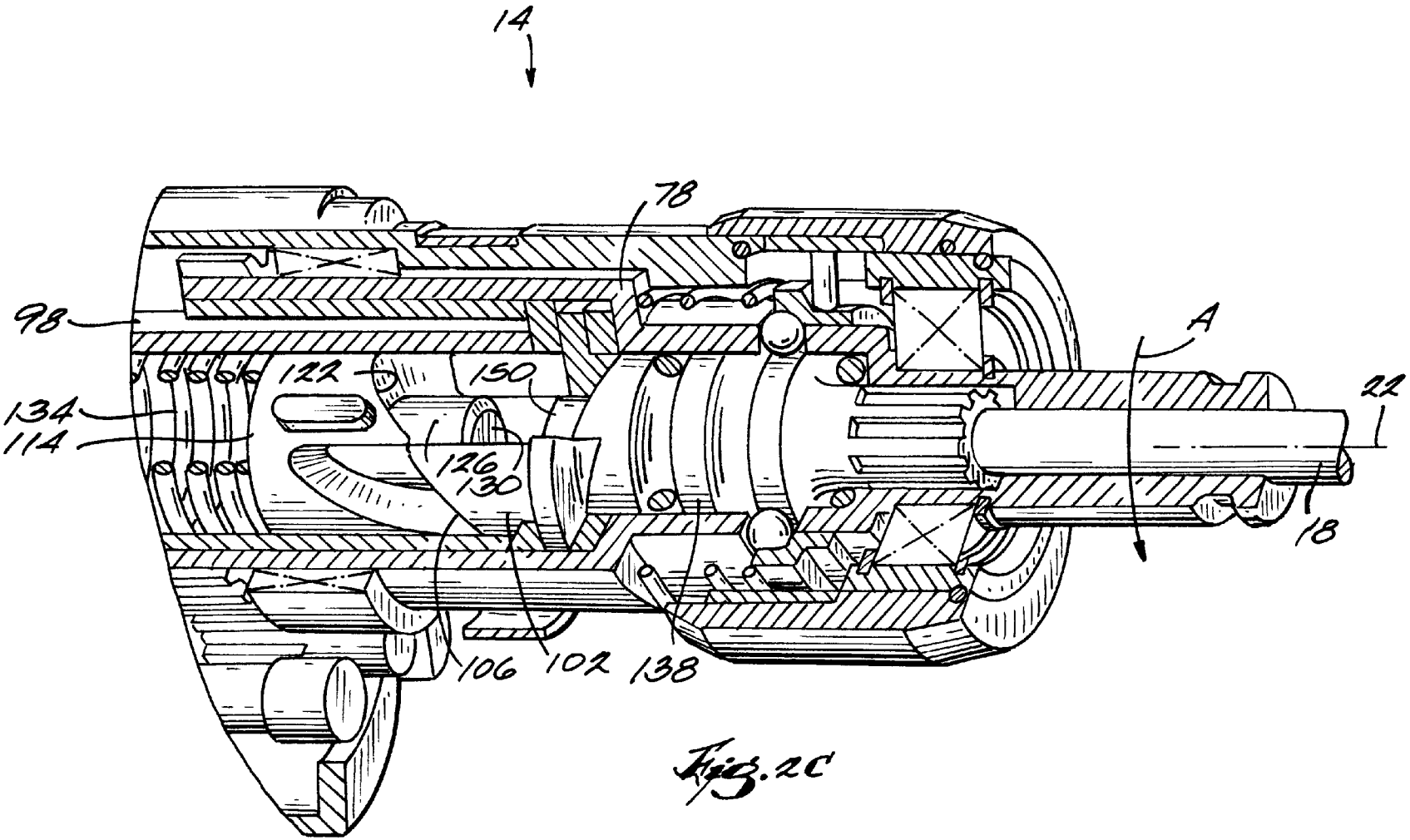
Figure 2D:
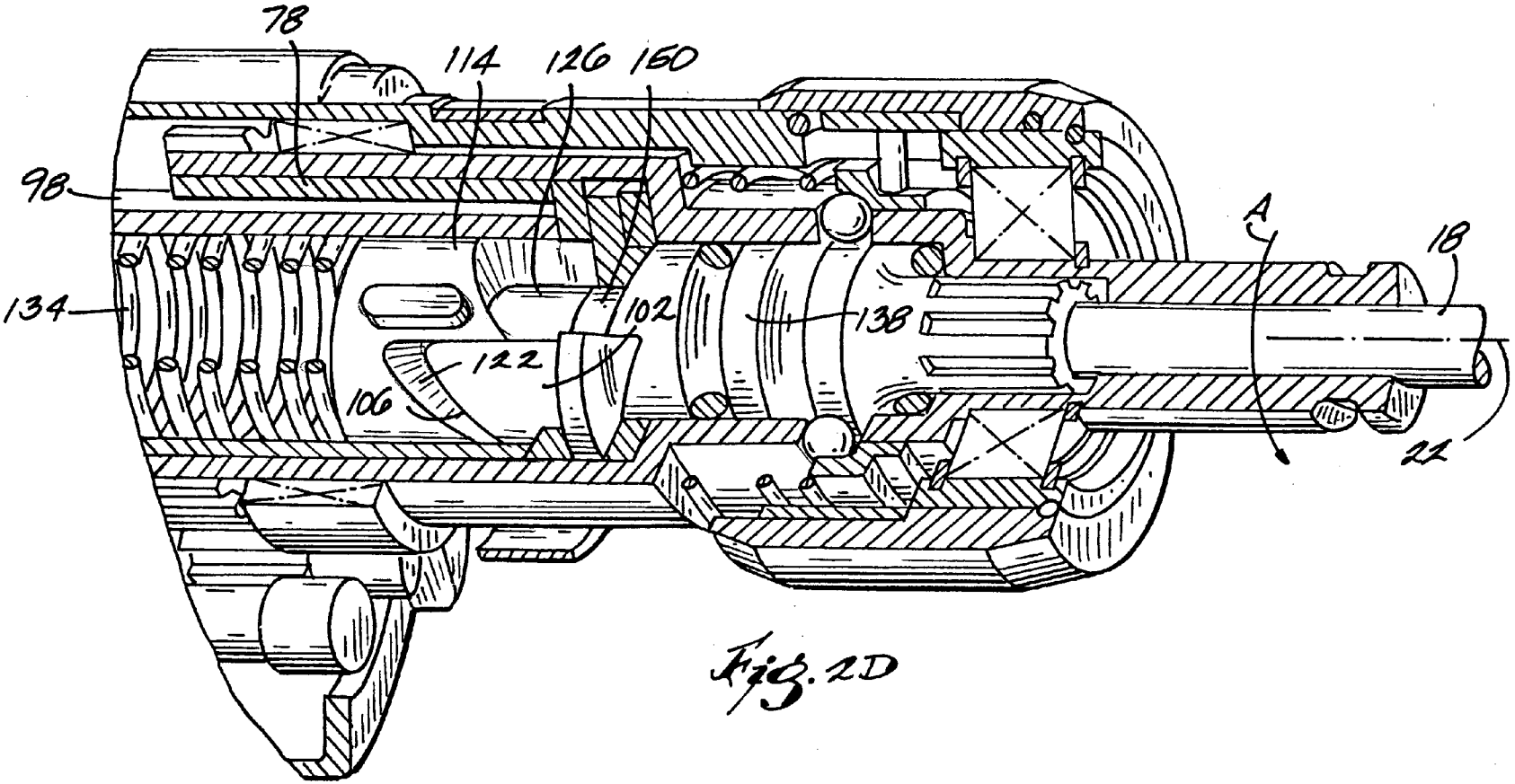

As the drive cam 102 and the impacting cam 114 continue to counter-rotate, the cam surfaces 106 and 122 eventually move past their respective apexes and disengage (see FIG. 2C). As a result, the impacting cam 114 is released, and the spring 134 forces the impacting cam 114 forwardly. As shown in FIG. 2D, the impacting surface 130 slams into the impact-receiving surface 152 on the striker 138, and the striker 138 transmits the impact to the tool element 18. After the impact, the cam surfaces 106 and 122 re-engage (as shown in FIG. 2A). The drive cam 102 and the impacting cam 114 continue to counter-rotate to cause the next impact.

If the motor 34 is reversed to drive the drive shaft 42 in an opposite or reverse direction, the spindle 78 and the striker 138 are driven in the direction opposite to arrow A, and the spring housing 98 and the impacting cam 114 driven in the direction of arrow A. Because of the configuration of the ratchet members 110 and 146, the drive cam 102 does not rotate with the spindle 78 and the striker 138, and the normal impacts are not generated by the hammer mechanism 14. Also, in this mode, the hammer mechanism 14 is usually placed in the non-hammering mode by the preventing mechanism 154 (i.e., in the mode shown in FIG. 4).

When the operator disengages the tool element 18 from the workpiece W, the striker 138 moves forwardly under the biasing force of the spring 134. The striker 138 and the drive cam 102 do not engage so the hammer mechanism 14 does not provide hammering. The hammer mechanism 14 may be prevented from moving to the hammer mode (ie., by moving the hammer mechanism 14 to the position shown in FIG. 4). To prevent the hammer mechanism 14 from being moved to the hammer mode, the locking collar 166 is rotated so that the balls 158 engage in the groove 148. The locking ring 178 prevents the balls from moving out of the groove 148. The striker 138 is thus prevented from moving rearwardly to engage the drive cam 102.

During hammering operations, the tool element 18 is rotated through a given degree of angular rotation between impacts. This continuing rotation, in combination with the number of cutting teeth 24 formed on the tool element 18, results in the creation of an impact pattern in the workpiece W.

The resulting impact pattern is a finction of the number of cutting teeth 24 on the tool element 18 and the rate of counter-rotation between impacts of the drive cam 102 relative to the impacting cam 114. With a tool element 18 having a selected number of cutting teeth 24, the resulting impact pattern can be selected to provide an optimal impact pattern for the material of the workpiece W by changing the rate of counter-rotation of the drive cam 102 and the impacting cam 114. The rate of counter-rotation can be adjusted by changing the gear ratio between the drive cam 102 and the drive shaft 42 and/or the gear ratio between the impacting cam 114 and the drive shaft 42.

Figure 5:
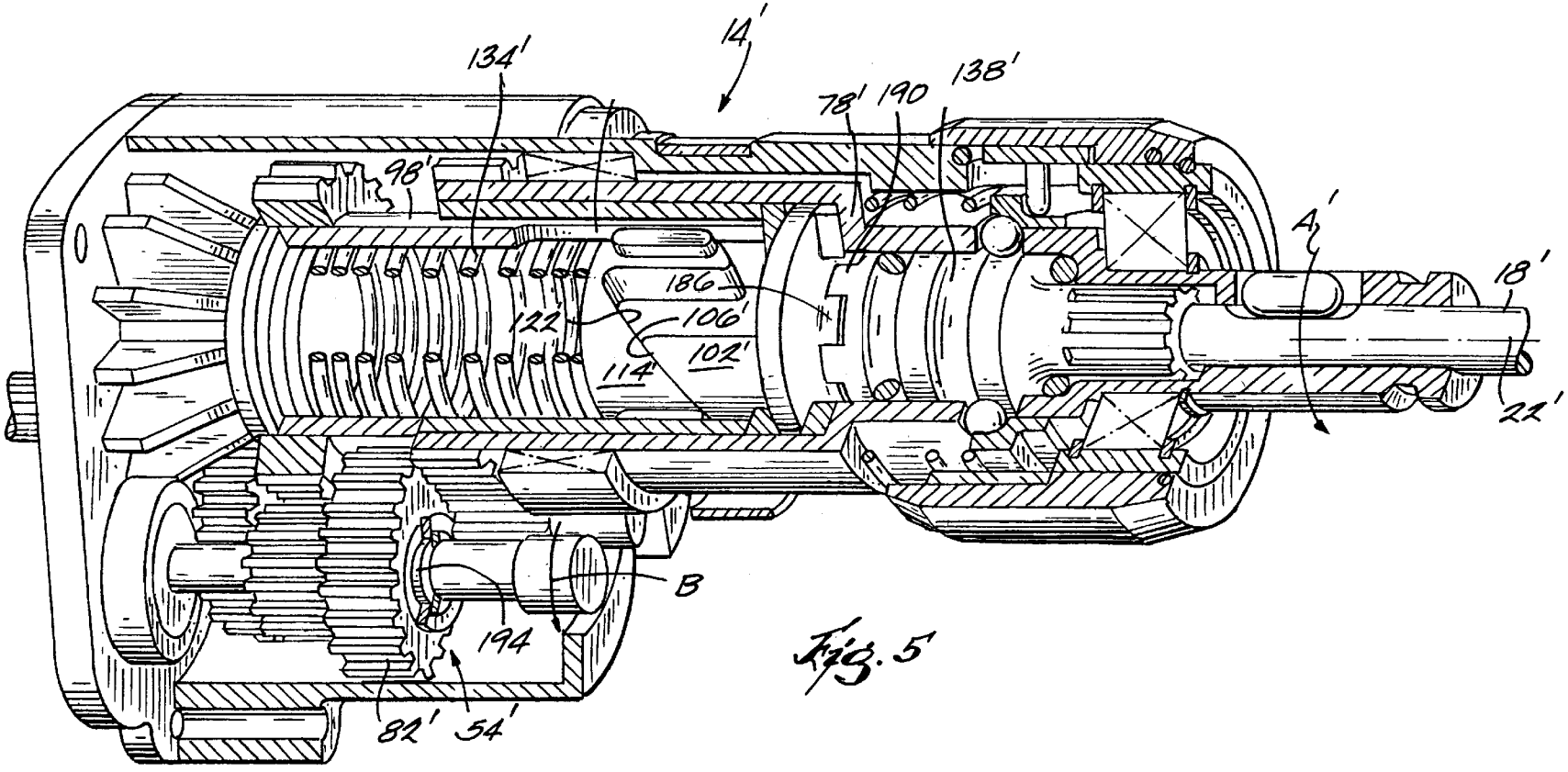
FIG. 5 is a perspective view of a first alternative construction of the hammer mechanism shown in FIG. 2A with portions cut away.

FIG. 5 illustrates a first alternative construction for a hammer mechanism 14' embodying the invention. Common elements are identified by the same reference numbers "'".

In this construction, the need for the ratchet members 110 and 146, formed on the drive cam 102 and the striker 138, respectively, is eliminated. Instead, straight-sided driving members 186 and 190 are formed on the drive cam 102' and the striker 138', respectively. Also, the idler gear 82' is fixed to a roller clutch 194. The roller clutch 194 only transmits torque in the direction of arrow B (in FIG. 5) and overruns in the other direction. When the motor 34' (not shown) is reversed, the spindle 78' rotates in the direction opposite to arrow A'. The striker 138' and the drive cam 102' rotate with the spindle 78'. In this direction, the roller clutch 194 slips so that the spring housing 98' and the impacting cam 114' are not driven. Instead, the impacting cam 114' is driven in the same direction by the drive cam 102', and impacts are not generated by the hammer mechanism 14'.

Figure 6:
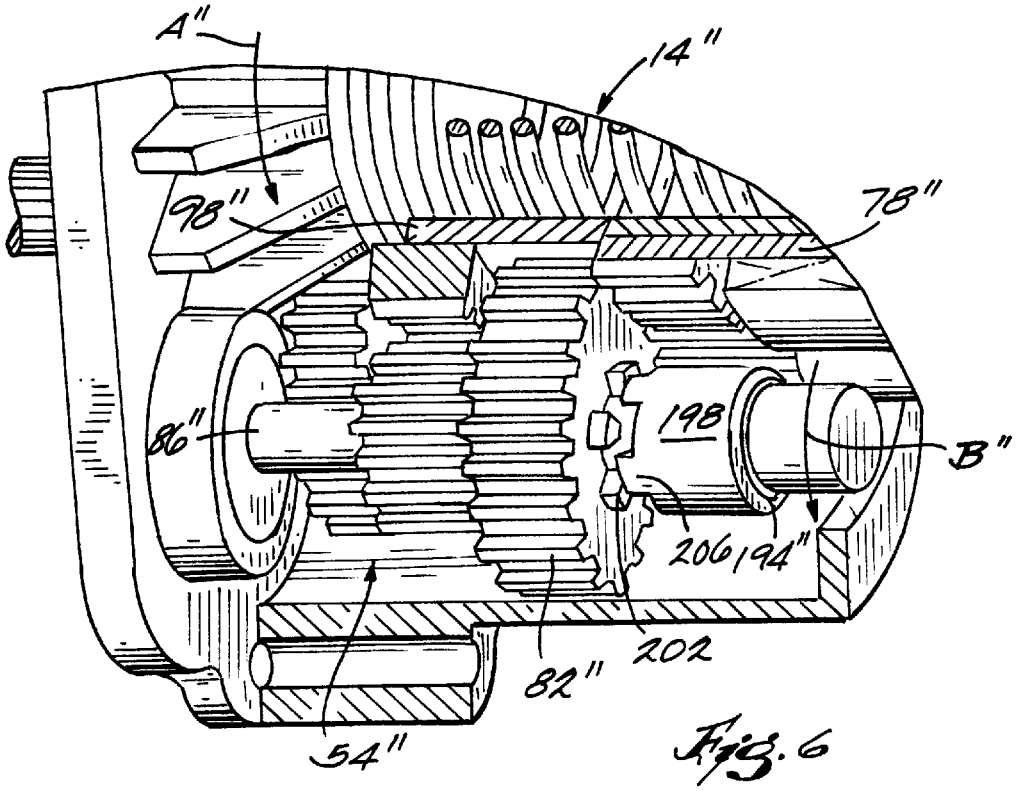
FIG. 6 is a perspective view of a second alternative construction of the hammer mechanism shown in FIG. 2A with portions cut away.

FIG. 6 illustrates a second alternative construction for a hammer mechanism 14" embodying the invention. Common elements are identified by the same reference numbers "'".

In this construction, the drive cam 102" and the striker 138" (not shown but similar to drive cam 102' and striker 138' shown in FIG. 5) include straight-sided driving members (not shown but similar to driving members 186 and 190 shown in FIG. 5). As shown in FIG. 6, the idler gear 82" is freely rotatable but axially fixed on the idler shaft 86". A shifter 198 is fixed to the roller clutch 194" so that the shifter 198 transmits torque in the direction of arrow B" and overruns in the other direction. The idler gear 82" and the shifter 198 include inter-engaging driving projections 202 and 206, respectively. The shifter 198 is movable on the idler shaft 86" so that the projections 202 and 206 are engageable.

When the projections 202 and 206 are engaged, the idler gear 82" transmits torque to the idler shaft 86" only in the direction of arrow B". When the spindle 78", the striker 138" and the drive cam 102" are driven in the direction of arrow A", the impacting cam 114" (not shown but similar to impacting cam 114') is counter-rotated, and hammering action is provided. When the spindle 78" is rotated in the opposite direction, the impacting cam 114" is not counter-rotated, and no hammering action is provided.

When the projections 202 and 206 are disengaged, the idler gear 82" freely rotates on the idler shaft 86". When the spindle 78" is rotated in either direction, the impacting cam 114" is not counter-rotated, and no hammering action is provided.

Figure 7:
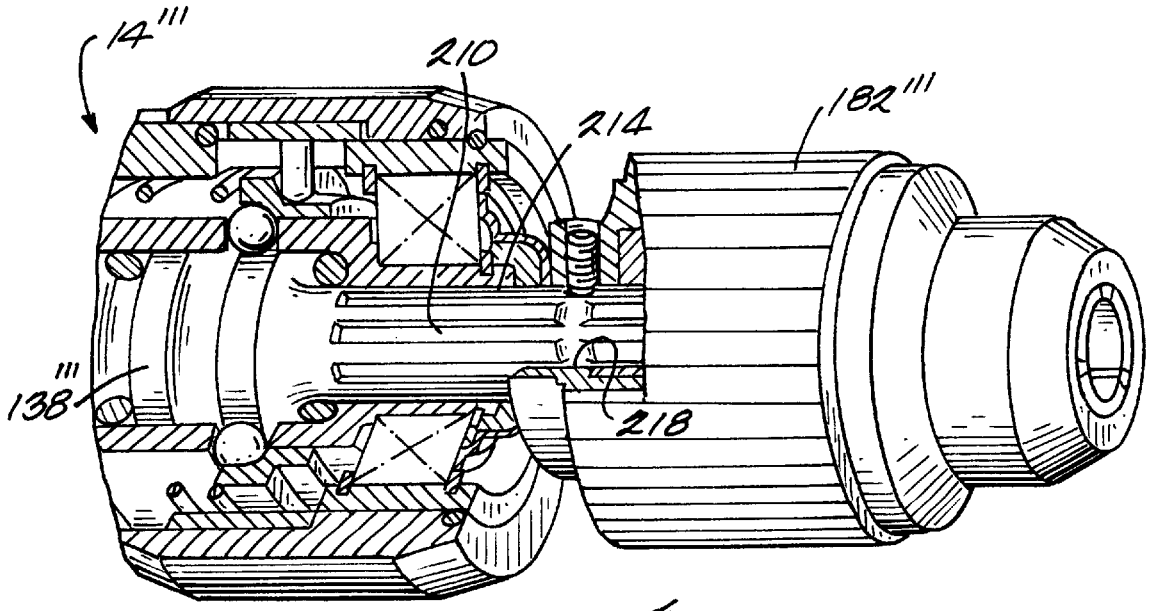
FIG. 7 is a perspective view of a third alternative construction of the hammer mechanism shown in FIG. 2A with portions cut away.
Figure 8A:
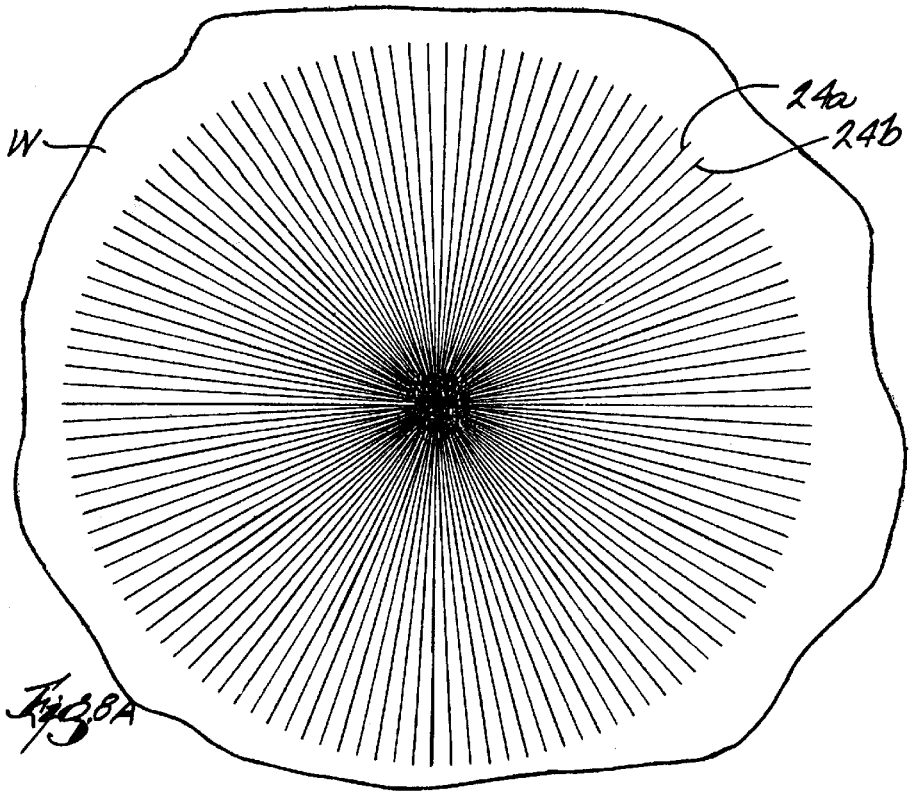
FIGS. 8A–B illustrate exemplary impact patterns on a workpiece created by a tool element driven by the hammer mechanism.
Figure 8B:
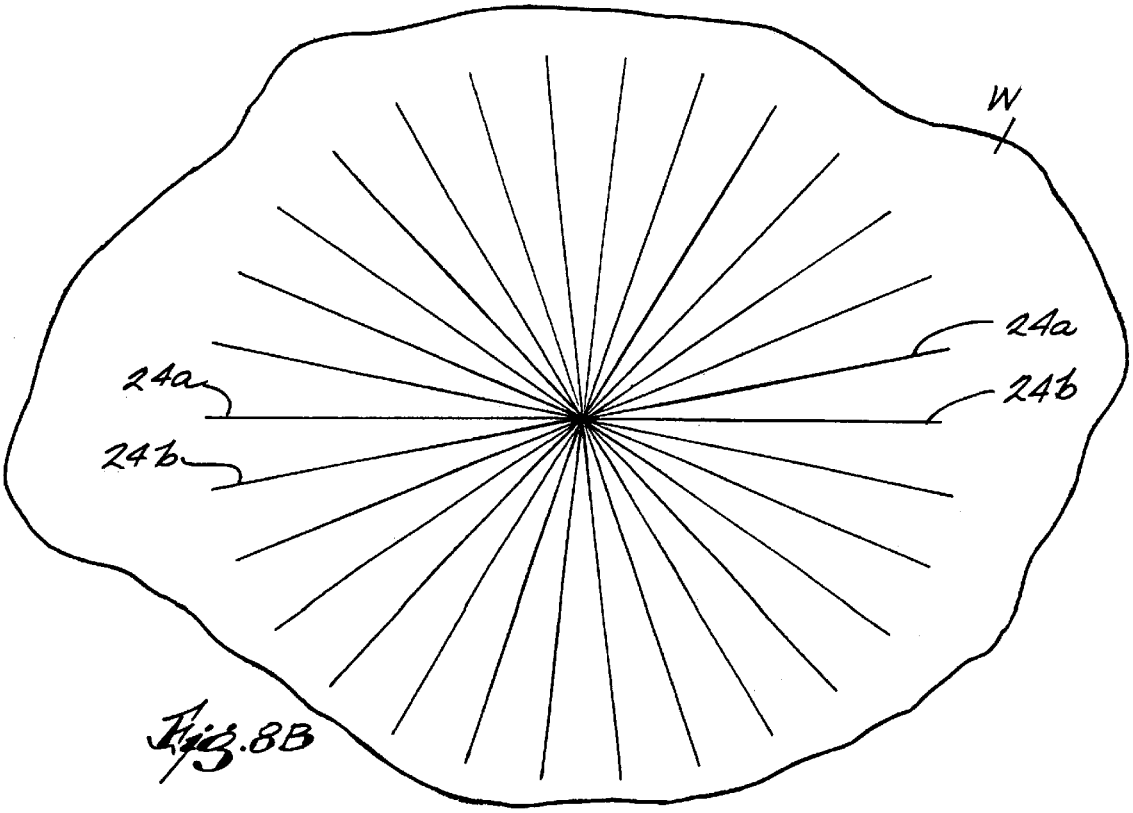

FIG. 7 illustrates a third alternative construction for a hammer mechanism 14'". Common elements are identified by the same reference numbers "'".

In this construction, the striker 138'" includes a forward projection 210 having axially-extending splines 214. A chucking device 182''' includes mating axial splines 218 and is mounted directly on the forward projection 210 of the striker 138''' so that the chucking device 182''' is axially fixed to the striker 138'''. The splines 214 and 218 ensure that rotary motion is transmitted from the striker 138''' to the chucking device 182''' and to the tool element 18'''.

Various features of the invention are set forth in the following claims.

I claim:

1. A drive mechanism for a power tool, the power tool including a housing, a motor supported by the housing and connectable to a power source, the motor including a rotatably driven drive shaft, and a support member supported by the housing, the support member being adapted to support a tool element so that the tool element is movable relative to the housing, the tool element having an axis and being driven by the power tool to work on a workpiece, said drive mechanism for imparting an axial motion on the tool element, said drive mechanism comprising:

a drive mechanism housing connectable to the housing of the power tool;

a first cam member rotatably supported by said drive mechanism housing and having at least one first cam surface, said first cam surface being oriented at a steep angle with respect to the axis of the tool element;

a second cam member rotatably supported by said drive mechanism housing and having at least one second cam surface engageable with said first cam surface, said second cam surface being oriented at a corresponding steep angle with respect to the axis of the tool element, said second cam member including an impacting surface for engaging the tool element to provide an impact; and a gear assembly supported by said drive mechanism housing and being drivingly connectable between the drive shaft and said first cam member and between the drive shaft and said second cam member so that said first cam member and said second cam member are counter-rotatable;

wherein, as said first cam member and said second cam member counter-rotate, said first cam surface and said second cam surface engage so that said second cam member is axially moved in a direction relative to said first cam member; and wherein, as said first cam member and said second cam member continue to counter-rotate, said first cam surface and said second cam surface disengage so that said second cam member is axially moved in an opposite direction relative to said first cam member to provide an impact on the tool element.

2. The drive mechanism as set forth in claim 1 wherein said first cam member includes a plurality of first cam surfaces, wherein said second cam member includes a plurality of second cam surfaces, and wherein there is a corresponding number of first cam surfaces and second cam surfaces.

3. The drive mechanism as set forth in claim 2 wherein each of said first cam member and said second cam member include less than five complementary cam surfaces.

4. The drive mechanism as set forth in claim 2 wherein each of said first cam member and said second cam member include two complementary cam surfaces.

5. The drive mechanism as set forth in claim 1 wherein each of said first cam surface and said second cam surface are oriented at between approximately 30° and 60° with respect to the axis of the tool element.

6. The drive mechanism as set forth in claim 1 wherein each of said first cam surface and said second cam surface are angled at least approximately 35° with respect to the axis of the tool element.

7. The drive mechanism as set forth in claim 1 wherein said first cam member and said second cam member are counter-rotated relative to one another.

8. The drive mechanism as set forth in claim 7 wherein said gear assembly includes a first gear drivingly connected to said first cam member, said first gear and the drive shaft having a first gear ratio, and a second gear drivingly connected to said second cam member, said second gear and the drive shaft have a second gear ratio.

9. The drive mechanism as set forth in claim 7 wherein said first cam member and said second cam member are counter-rotated relative to one another at a rate of counter-rotation, wherein the tool element has a cutting tooth, wherein the tool element is rotatably driven so that the cutting tooth provides an impact pattern in the workpiece, and wherein said rate of counter-rotation is selectable to change the impact pattern of the cutting tooth in the workpiece.

10. The drive mechanism as set forth in claim 1 wherein said drive mechanism is formed a modular assembly, and wherein said modular assembly is connected to the housing of the power tool and to the motor.

11. The drive mechanism as set forth in claim 1 and further comprising:

a spring for biasing said first cam member and said second cam member into engagement; and a spring housing supporting said spring and said second cam member, said spring being between said spring housing and said second cam member, said spring housing being rotatably supported by said housing and being connected between said gear assembly and said second cam member.

12. The drive mechanism as set forth in claim 1 and further comprising a striker member supported by said drive mechanism housing in force transmitting relation to the tool element, said striker member having an impact-receiving surface engageable by said impacting surface of said second cam member, wherein, before said plurality of first cam surfaces and said second cam surfaces re-engage, said impacting surface impacts said impact receiving surface to provide an impact to the tool element.

13. The drive mechanism as set forth in claim 1 and further comprising a preventing mechanism to prevent said drive mechanism from imparting axial motion on the tool element, said preventing mechanism being operable to one of selectively disconnect said first cam member from the drive shaft and selectively disconnect said second cam member from the drive shaft.

14. The drive mechanism as set forth in claim 13 said preventing mechanism is operable to selectively disconnect said first cam member from the drive shaft by selectively disconnecting said first cam member from the gear assembly.

15. The drive mechanism as set forth in claim 13 wherein said gear assembly includes a first gear connected between said first cam member and the drive shaft, and a second gear connected between said second cam member and the drive shaft, wherein said preventing mechanism is operable to selectively disconnect said second cam member from the drive shaft by selectively disconnecting said second gear from said second cam member.

16. A power tool comprising:

a housing;

a motor supported by said housing and being connectable to a power source, said motor including a rotatably driven drive shaft;

a support member supported by said housing, said support member being adapted to support a tool element so that the tool element is movable relative to the housing, the tool element having an axis and being driven by said power tool to work on a workpiece; and a drive mechanism connectable to said drive shaft and operable to impart an axial motion on the tool element, said drive mechanism including a first cam member rotatably supported by said housing and having at least one first cam surface, said first cam surface being oriented at a steep angle with respect to the axis of the tool element, a second cam member rotatably supported by said housing and having at least one second cam surface engageable with said first cam surface, said second cam surface being oriented at a corresponding steep angle with respect to the axis of the tool element, said second cam member including an impacting surface for engaging the tool element to provide an impact, and a gear assembly supported by said housing and being drivingly connectable between said drive shaft and said first cam member and between said drive shaft and said second cam member so that said first cam member and said second cam member are counter-rotatable;

wherein, as said first cam member and said second cam member counter-rotate, said first cam surface and said second cam surface engage so that said second cam member is axially moved in a direction relative to said first cam member; and wherein, as said first cam member and said second cam member continue to counter-rotate, said first cam surface and said second cam surface disengage so that said second cam member is axially moved in an opposite direction relative to said first cam member to provide an impact on the tool element.

17. The power tool as set forth in claim 16 wherein said first cam member has a plurality of first cam surfaces, wherein said second cam member has a plurality of second cam surfaces engageable with said plurality of first cam surfaces, there being a corresponding number of first cam surfaces and second cam surfaces, said second cam member including an impacting surface for engaging the tool element to provide the impact.

18. The power tool as set forth in claim 16 wherein said first cam member has two first cam surfaces, wherein said second cam member has two second cam surfaces engageable with said first cam surfaces.

19. The power tool as set forth in claim 16 wherein each of said first cam surface and said second cam surface are oriented at between approximately 30° and 60° with respect to the axis of the tool element.

20. The power tool as set forth in claim 16 wherein each of said first cam surface and said second cam surface are angled at least approximately 35° with respect to the axis of the tool element.

21. The power tool as set forth in claim 16 wherein said first cam member and said second cam member are counter-rotated relative to one another at a rate of counter-rotation, wherein the tool element has a cutting tooth, wherein the tool element is rotatably driven so that the cutting tooth provides an impact pattern in the workpiece, and wherein said rate of counter-rotation is selectable to change the impact pattern of the cutting tooth in the workpiece.

22. A method for operating a power tool to drive a tool element, the power tool including a housing, a motor supported by the housing and connectable to a power source, the motor including a rotatably driven drive shaft, a support member supported by the housing and adapted to support a tool element so that the tool element is movable relative to the housing, the tool element having an axis and including a cutting tooth, the tool element being driven by the power tool to work on a workpiece, and a drive mechanism for imparting an axial motion and a rotary motion on the tool element so that the cutting tooth creates an impact pattern on the workpiece, the drive mechanism including a first cam member rotatably supported by the housing and at least one first cam surface, a second cam member rotatably supported by the housing and having at least one second cam surface engageable with the first cam surface, the second cam member including an impacting surface for engaging the tool element to provide an impact, and a gear assembly supported by the housing and operable to drive the first cam member and the second cam member for counter-rotation, the gear assembly being drivingly connected between the first cam member and the drive shaft and between the second cam member and the drive shaft, wherein, as the first cam member and the second cam member counter-rotate, the first cam surface and the second cam surface engage so that the second cam member is axially moved in a direction relative to the first cam member, and wherein, as the first cam member and the second cam member continue to counter-rotate, the first cam surface and the second cam surface disengage so that the second cam member is axially moved in an opposite direction relative to the first cam member to provide an impact on the tool element, said method comprising:

(a) selecting a first gear ratio between the first cam member and the drive shaft;

(b) selecting a second gear ratio between the second cam member and the drive shaft; and (c) changing one of the first gear ratio and the second gear ratio to optimize the impact pattern created by the cutting tooth.

* * * * *